US011020790B2

(12) United States Patent
Wu

(10) Patent No.: US 11,020,790 B2
(45) Date of Patent: Jun. 1, 2021

(54) MANUAL RIVET TOOL

(71) Applicant: Shanghai Well-done Machinery Manufacturing Co., Ltd., Shanghai (CN)

(72) Inventor: Mingxiang Wu, Shanghai (CN)

(73) Assignee: Shanghai Well-Done Machinery Manufacturing Co., Ltd., Shanghai (CN)

( * ) Notice: Subject to any disclaimer, the term of this patent is extended or adjusted under 35 U.S.C. 154(b) by 143 days.

(21) Appl. No.: 16/242,759

(22) Filed: Jan. 8, 2019

(65) Prior Publication Data

US 2019/0210094 A1 Jul. 11, 2019

(30) Foreign Application Priority Data

Jan. 10, 2018 (CN) ..... 201820039339.6

(51) Int. Cl.
*B21J 15/38* (2006.01)
*B25B 27/00* (2006.01)
*B21J 15/04* (2006.01)

(52) U.S. Cl.
CPC ..... *B21J 15/383* (2013.01); *B21J 15/386* (2013.01); *B25B 27/0007* (2013.01); *B21J 15/043* (2013.01)

(58) Field of Classification Search
CPC ..... B21J 15/04; B21J 15/041; B21J 15/043; B21J 15/105; B21J 15/16; B21J 15/383; B21J 15/386; B21J 15/022; B21J 15/046; B21J 15/14; B25B 27/0007
See application file for complete search history.

(56) References Cited

U.S. PATENT DOCUMENTS 5,079,818 A * 1/1992 Schwab ..... B21J 15/043 29/243.527

* cited by examiner

*Primary Examiner* — Matthew Katcoff
(74) *Attorney, Agent, or Firm* — Muncy, Geissler, Olds & Lowe, P.C.

(57) ABSTRACT

The present invention discloses a manual rivet tool, comprising a first handle assembly, a second handle assembly, a force amplification pulling mechanism, a planetary accelerating rotating mechanism and a quick replacement mechanism; the first handle assembly is fixed to the force amplification pulling mechanism; the second handle assembly is disposed on the force amplification pulling mechanism; the first handle assembly and the second handle assembly act on the force amplification pulling mechanism cooperatively to drive the force amplification pulling mechanism to output a pulling force; a threaded brace rod is fixed to the end of the force amplification pulling mechanism through the quick replacement mechanism, and the force amplification pulling mechanism outputs the pulling force to the threaded brace rod to act on a rivet nut; and the planetary accelerating rotating mechanism is engaged on the upper end of the force amplification pulling mechanism, and the planetary accelerating rotating mechanism drives the threaded brace rod to rotate rapidly by means of the force amplification pulling mechanism. The present application may complete manual riveting efficiently, and the tool is light in structure, convenient to carry, strong in pulling force, labor saving in operation and high in working efficiency.

8 Claims, 2 Drawing Sheets

MANUAL RIVET TOOL

FIELD OF THE INVENTION

The present invention relates to a quick rivet tool, in particular to a manual rivet tool.

DESCRIPTION OF THE RELATED ART

The wide application of blind rivets and rivet nuts proposes a new demand for a tool matching therewith. The tool shall be simple, light, convenient and labor saving in use.

The traditional manual rivet tools in the market are large in size and laborious in operation. The pneumatic rivet tools need compressed air as the power, thus affecting the scope of application. The electric rivet tools have complex structure and a lot of parts, which is prone to failure. The electric rivet tools are subject to the power of a motor and cannot be used to rivet large parts to be riveted (blind rivets or rivet nuts). The electric rivet tool requires charging the batter due to the battery capacity constraints, and cannot operate normally at low temperature.

In addition, the traditional rivet tool tip has a single color regardless of the size, and it is thus difficult to identify the size of the tip, thereby causing inconvenience in use.

SUMMARY OF THE INVENTION

With regard to the shortcomings above in the prior art, the Applicant puts forwards a manual rivet tool capable of solving the current problems of the manual rivet tool in the market such as large size and laborious operation.

The present application uses the following technical means for achieving the technical purposes above:

A manual rivet tool comprises: a first handle assembly, a second handle assembly, a force amplification pulling mechanism, a planetary accelerating rotating mechanism and a quick replacement mechanism; the first handle assembly is fixed to the force amplification pulling mechanism; the second handle assembly is disposed on the force amplification pulling mechanism; the first handle assembly and the second handle assembly act on the force amplification pulling mechanism cooperatively to drive the force amplification pulling mechanism to output a pulling force; a threaded brace rod is fixed to the end of the force amplification pulling mechanism through the quick replacement mechanism, and the force amplification pulling mechanism outputs the pulling force to the threaded brace rod to act on a rivet nut; and the planetary accelerating rotating mechanism is engaged on the upper end of the force amplification pulling mechanism, and the planetary accelerating rotating mechanism drives the threaded brace rod to rotate rapidly by means of the force amplification pulling mechanism.

Preferably, the force amplification pulling mechanism comprises: a pull rod, a nut being disposed on the upper part thereof, the upper end of the pull rod being engaged with the planetary accelerating rotating mechanism, and the lower end of the pull rod being connected to the quick replacement mechanism; a ball screw, sleeved on the outer side of the pull rod and having the upper end surface in contact with the lower end surface of the nut, the upper end of the ball screw being provided with a thread sleeve and being in contact with the first handle assembly through the thread sleeve, and the lower end of the ball screw abutting against the quick replacement mechanism; a ball nut, sleeved outside the ball screw, and a ball being provided between the ball nut and the ball screw; a ratchet, disposed on the outer side of the ball nut and being in clamp connection with the ball nut, the second handle assembly being disposed on the ratchet; a housing with hollow interior, the upper end of the housing being connected to the planetary accelerating rotating mechanism through bolt fixing, the housing being sleeved on the upper segment of the ball nut, and the upper end surface of the housing being connected to the lower end surface of the first handle assembly; and a tip base, sleeved on the lower segment of the ball nut, the upper end of the tip base being connected to the lower end surface of the ratchet, the bottom of the tip base being connected with a tip through a locking nut, a step internal hole being disposed in the tip base, a step surface of the step internal hole limiting the bottom end of the ball screw, a thrust bearing being disposed between the ball nut and the step surface, and an internal hole below the step surface being sleeved on the quick replacement mechanism.

Preferably, a sun gear is disposed on the upper end of the pull rod, and the sun gear is engaged with the planetary accelerating rotating mechanism.

Preferably, a cord is disposed on the outer side surface of the ball nut, a slot corresponding to the cord is disposed on the inner surface of the ratchet, and the cord is confined in the slot.

Preferably, the housing is composed of a scale ring, a display cover and a damping ring; the upper end of the display cover is fixed to the first handle assembly through the bolt, and the display cover is in an inverted L shape; the damping ring is sleeved on the ball nut and the damping ring is located between the display cover and the ball nut; the scale ring is sleeved on the ball nut and located below the damping ring, the outer surface of the scale ring is provided with a tick mark and a corresponding figure, and the display cover may move up and down with respect to the tick mark.

Preferably, a distinctive mark is disposed on the tip, and the distinctive mark is in one-to-one correspondence with each type of the threaded brace rod so as to directly distinguish each type of threaded brace rod.

Preferably, the quick replacement mechanism comprises a reset spring and a replacement sleeve; the reset spring is sleeved on the bottom end of the pull rod, and the upper end of the reset spring abuts against the bottom end of the ball screw; one end of the replacement sleeve is sleeved on the pull rod and the other end thereof is sleeved and connected to the threaded brace rod; and both the threaded brace rod and the pull rod are provided with connecting ends corresponding to the replacement sleeve.

Preferably, the planetary accelerating rotating mechanism comprises a knob, a knob base, an internal gear, an internal gear base, a planetary gear base and three planetary gears mounted on the planetary gear base, wherein the internal gear is disposed in the internal gear base, the internal gear base is sleeved on the knob base, and the knob base is fixed to the force amplification pulling mechanism by means of the bolt; the planetary gear base is mounted in the middle of the internal gear base, the three planetary gears mounted on the planetary gear base are simultaneously engaged with the internal gear and the sun gear on the pull rod, and the knob is connected to the planetary gear base.

Preferably, the second handle assembly comprises a second handle bar, a pawl spring, a steel ball and a ratchet pawl; the front end of the second handle bar is provided with an inner hole, the pawl spring is disposed at the innermost side of the inner hole, the steel ball abuts against the ratchet pawl under the elastic force of the pawl spring, and the ratchet pawl clings to the ratchet under the action of the steel ball and catches teeth of the ratchet.

With the technical means above, the present application may complete manual riveting efficiently, and the tool is light in structure, convenient to carry, strong in pulling force, labor saving in operation and high in working efficiency.

DESCRIPTION OF THE PREFERRED EMBODIMENT

The technical solution of the present invention will be further described in detail in combination with embodiments and drawings.

Figure 1:
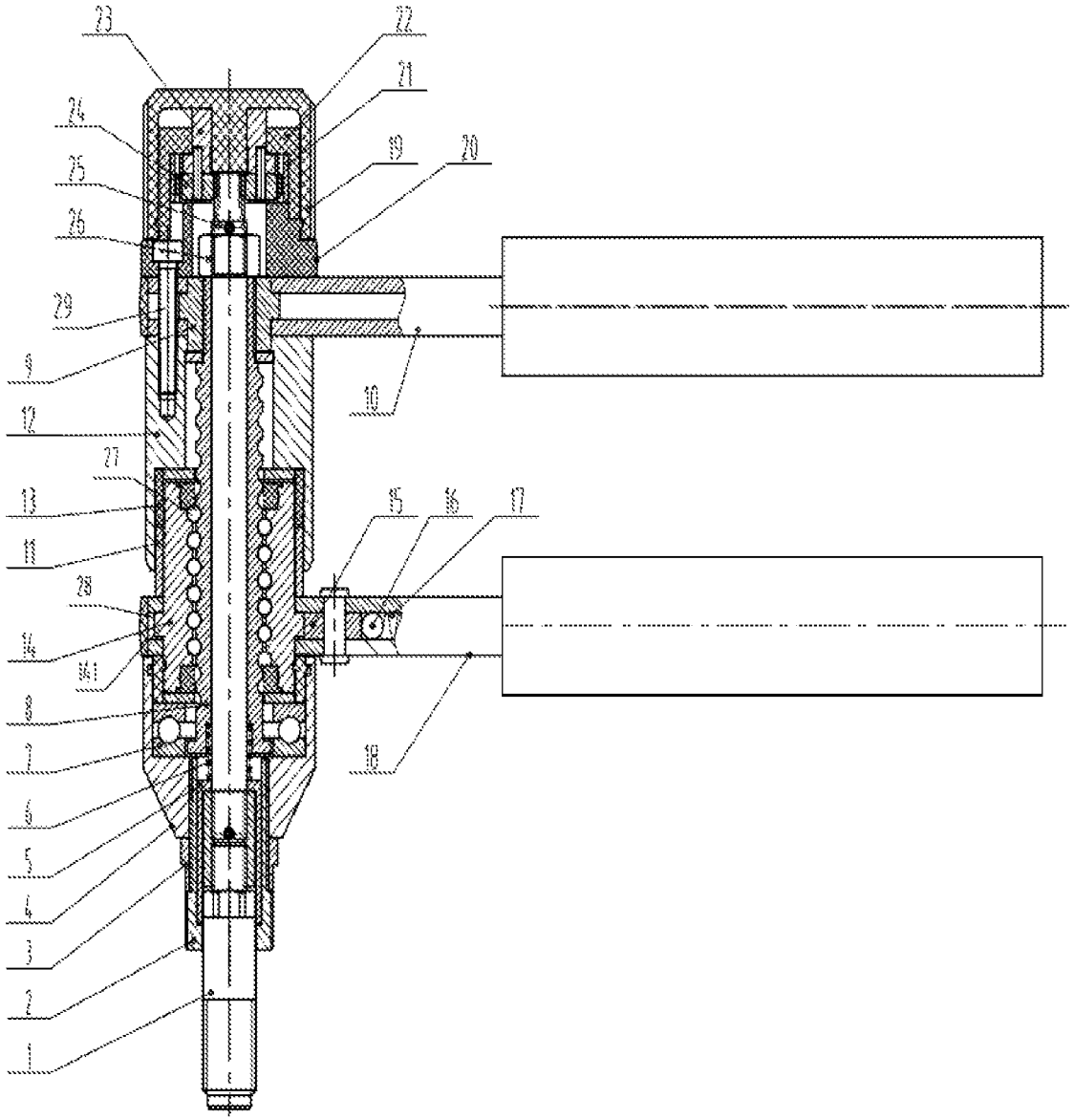
FIG. 1 is a profile of an embodiment according to the present application.
Figure 2:
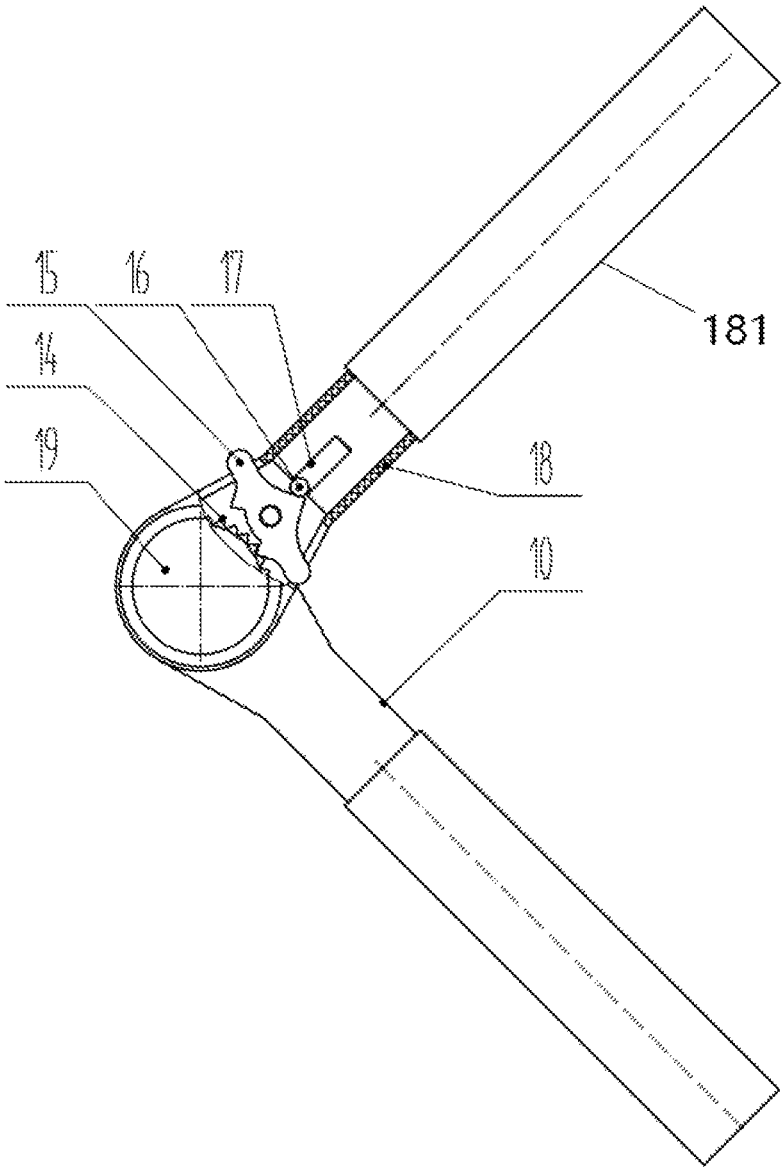
FIG. 2 is a top view of an embodiment according to the present application.

FIG. 1 and FIG. 2 are a profile and a top view of an embodiment according to the present application. A manual rivet tool in the present embodiment comprises a first handle assembly 10, a second handle assembly 18, a force amplification pulling mechanism, a planetary accelerating rotating mechanism and a quick replacement mechanism.

The first handle assembly 10 is fixed to the force amplification pulling mechanism. The second handle assembly 18 is disposed on the force amplification pulling mechanism. The first handle assembly 10 and the second handle assembly 18 act on the force amplification pulling mechanism cooperatively to drive the force amplification pulling mechanism to output a pulling force. The cooperation is that the first handle assembly 10 is fixed as a fixed point of force application, while the second handle assembly 18 rotates with respect to the first handle assembly 10.

A threaded brace rod 1 is fixed to the end of the force amplification pulling mechanism through the quick replacement mechanism, and the force amplification pulling mechanism outputs the pulling force to the threaded brace rod 1 to act on a rivet nut. The planetary accelerating rotating mechanism is engaged on the upper end of the force amplification pulling mechanism, and the planetary accelerating rotating mechanism drives the threaded brace rod to rotate rapidly by means of the force amplification pulling mechanism.

Various parts will be described as follows in detail by referring to FIG. 1.

The force amplification pulling mechanism comprises a pull rod 25, a ball screw 8, a ball nut 14, a ball 27, a ratchet 28, a housing and a tip base 4.

As shown in FIG. 1, a nut 26 is disposed on the upper part of the pull rod 25, the upper end of the pull rod 25 is provided with a sun gear, and the sun gear is engaged with the planetary accelerating rotating mechanism. The pull rod 25, driven by the planetary accelerating rotating mechanism, may realize accelerating rotation. The lower end of the pull rod 25 is connected to the quick replacement mechanism and is connected to a threaded brace rod 1 by means of the quick replacement mechanism.

The ball screw 8 is sleeved on the outer side of the pull rod 25, the upper end surface of the ball screw 8 is in contact with the lower end surface of the nut 26 and is used for transmitting the pulling force of the ball screw 8 in the pulling direction. The upper end of the ball screw 8 is provided with a hex thread sleeve 9 and is connected to the first handle assembly 10 through the hex thread sleeve 9, and the first handle assembly 10 cannot rotate. The lower end of the ball screw 8 abuts against the quick replacement mechanism.

The ball nut 14 is sleeved outside the ball screw 8, and a ball 27 is provided between the ball nut 14 and the ball screw 8. A cord 141 is disposed on the outer side surface of the ball nut 14.

The ratchet 28 is disposed on the outer side of the ball nut 14. A slot corresponding to the cord 141 is disposed on the inner surface of the ratchet 28, and the cord 141 is confined in the slot. The second handle assembly 18 is disposed on the ratchet 28.

The interior of the housing is hollow, and the upper end of the housing is connected to the planetary accelerating rotating mechanism through bolt fixing. In the present embodiment, the housing is composed of a scale ring 11, a display cover 12 and a damping ring 13. As shown in FIG. 1, the upper end of the display cover 12 is fixed to the first handle assembly 10 through the bolt 29, and the display cover 12 is in an inverted L shape. The damping ring 13 is sleeved on the ball nut 14 and the damping ring 13 is located between the display cover 12 and the ball nut 14. The scale ring 11 is sleeved on the ball nut 14 and located below the damping ring 13, the outer surface of the scale ring 11 is provided with a tick mark and a corresponding figure, and the display cover 12 may spiral up and down with respect to the tick mark. The outer surface of the scale ring 11 is provided with a tick mark and a corresponding figure, and the movement distance of the threaded brace rod 1 with respect to the tip 2 may be learnt from the position of the display cover 12 with respect to the tick mark 11. In addition, the damping ring 13 is pressed in the display cover 12, and the clamping force of the damping ring 13 prevents the ball screw 8 from going backwards while the first handle assembly 10 and the second handle assembly 18 are pulled out.

The tip base 4 is sleeved on the lower segment of the ball nut 14, the upper end of the tip base 4 is connected to the lower end surface of the ratchet 28, and the bottom of the tip base 4 is connected with a tip 2 through a locking nut 3. A step internal hole is disposed in the tip base 4, a step surface of the step internal hole limits the bottom end of the ball screw 8, and a thrust bearing 7 is disposed between the ball nut 14 and the step surface. An internal hole below the step surface is sleeved on the quick replacement mechanism.

A distinctive mark is disposed on the tip 2, and the distinctive mark is in one-to-one correspondence with each type of the threaded brace rod so as to directly distinguish each type of threaded brace rod. The distinctive mark may be color. For example, tips with different color are set, and each color corresponds to a type, which is convenient to quickly identify the size of a tip.

As shown in FIG. 1 and FIG. 2, the second handle assembly 18 comprises a second handle bar 181, a pawl spring 17, a steel ball 16 and a ratchet paw 15. The front end of the second handle bar 181 is provided with an inner hole, and the pawl spring 17 is disposed at the innermost side of the inner hole. The steel ball 16 abuts against the ratchet pawl 15 under the elastic force of the pawl spring 17, and the ratchet pawl 15 clings to the ratchet 28 under the action of the steel ball 16 and catches teeth of the ratchet 28.

The first handle assembly 10 and the second handle assembly 18 are pushed, and the second handle assembly 18 pushes the ball nut 14 through the ratchet pawl 15 to rotate (the ratchet pawl 15 is shifted as needed to rotate the ball nut 14 forward or backward). The ball screw 8 moves in the pulling direction to output a pulling force in the pulling direction and transmit the pulling force to the threaded brace rod 1 through the pull rod 25. The pulling force acts on the threaded brace rod 1 and clings to the rivet nut on the tip 2, thus deforming the rivet nut till the completion of riveting.

As shown in FIG. 1, the quick replacement mechanism comprises a reset spring 6 and a replacement sleeve 5. The reset spring 6 is sleeved on the bottom end of the pull rod 25, and the upper end of the reset spring 6 abuts against the bottom end of the ball screw 8. One end of the replacement sleeve 5 is sleeved on the pull rod 25 and the other end thereof is sleeved and connected to the threaded brace rod 1. The replacement sleeve 5 is provided with an inner hexagonal hole thereon, and both the threaded brace rod 1 and the pull rod 25 are provided with connecting ends corresponding to the replacement sleeve, that is, outer hexagons. The replacement sleeve 5 is pushed to disengage the hexagon of the threaded brace cord 1 from the inner hexagonal hole of the replacement sleeve 5, and it is thus possible to replace the threaded brace rod 1 quickly and conveniently.

The planetary accelerating rotating system comprises a knob 19, a knob base 20, an internal gear 21, an internal gear base 22, a planetary gear base 23 and three planetary gears 24 mounted on the planetary gear base 23. The internal gear 21 is disposed in the internal gear base 22, the internal gear base 22 is sleeved on the knob base 20, and the planetary gear base 23 is mounted in the middle of the internal gear base 22. The three planetary gears 24 mounted on the planetary gear base 23 are simultaneously engaged with the internal gear 21 and the sun gear on the pull rod 25, and the knob 19 is connected to the planetary gear base 23. The knob 19 is rotated to drive the planetary gear base 23 to rotate. The speed-changing effect of a planetary gear train enables the pull rod 25 provided with a gear to drive the threaded brace rod 1 (clockwise or anticlockwise) so as to quickly rotate at a speed several times the rotation speed of the knob 19, which may quickly assemble or disassemble a rivet nut on the threaded brace rod 1 of the tool.

Such embodiments are only used to describe the present utility model but not limit the scope thereof. Any equal changes and modifications made to the present invention by a person skilled in the art shall fall into the scope of claims attached to the present invention.

The invention claimed is:

1. A manual rivet tool, comprising:

a first handle assembly;

a second handle assembly;

a force amplification pulling mechanism, comprising:

a pull rod, a nut being disposed on the upper part thereof, the upper end of the pull rod being engaged with the planetary accelerating rotating mechanism, and the lower end of the pull rod being connected to the quick replacement mechanism;

a ball screw, sleeved on the outer side of the pull rod and having the upper end surface in contact with the lower end surface of the nut, the upper end of the ball screw being provided with a thread sleeve and being in contact with the first handle assembly through the thread sleeve, and the lower end of the ball screw abutting against the quick replacement mechanism;

a ball nut, sleeved outside the ball screw, and a ball being provided between the ball nut and the ball screw;

a ratchet, disposed on the outer side of the ball nut and being in clamp connection with the ball nut, the second handle assembly being disposed on the ratchet;

a housing with hollow interior, the upper end of the housing being connected to the planetary accelerating rotating mechanism through bolt fixing, the housing being sleeved on the upper segment of the ball nut, and the upper end surface of the housing being connected to the lower end surface of the first handle assembly; and a tip base, sleeved on the lower segment of the ball nut, the upper end of the tip base being connected to the lower end surface of the ratchet, the bottom of the tip base being connected with a tip through a locking nut, a step internal hole being disposed in the tip base, a step surface of the step internal hole limiting the bottom end of the ball screw, a thrust bearing being disposed between the ball nut and the step surface, and an internal hole below the step surface being sleeved on the quick replacement mechanism;

a planetary accelerating rotating mechanism; and a quick replacement mechanism, wherein the first handle assembly is fixed to the force amplification pulling mechanism; the second handle assembly is disposed on the force amplification pulling mechanism; the first handle assembly and the second handle assembly act on the force amplification pulling mechanism cooperatively to drive the force amplification pulling mechanism to output a pulling force, wherein a threaded brace rod is fixed to the end of the force amplification pulling mechanism through the quick replacement mechanism, and the force amplification pulling mechanism outputs the pulling force to the threaded brace rod to act on a rivet nut, and wherein the planetary accelerating rotating mechanism is engaged on the upper end of the force amplification pulling mechanism, and the planetary accelerating rotating mechanism drives the threaded brace rod to rotate rapidly by means of the force amplification pulling mechanism.

2. The manual rivet tool according to claim 1, wherein a sun gear is disposed on the upper end of the pull rod, and the sun gear is engaged with the planetary accelerating rotating mechanism.

3. The manual rivet tool according to claim 1, wherein a cord is disposed on the outer side surface of the ball nut, a slot corresponding to the cord is disposed on the inner surface of the ratchet, and the cord is confined in the slot.

4. The manual rivet tool according to claim 1, wherein the housing is composed of a scale ring, a display cover and a damping ring; the upper end of the display cover is fixed to the first handle assembly through the bolt, and the display cover is in an inverted L shape; the damping ring is sleeved on the ball nut and the damping ring is located between the display cover and the ball nut; the scale ring is sleeved on the ball nut and located below the damping ring, the outer surface of the scale ring is provided with a tick mark and a corresponding figure, and the display cover may move up and down with respect to the tick mark.

5. The manual rivet tool according to claim 1, wherein a distinctive mark is disposed on the tip, and the distinctive mark is in one-to-one correspondence with each type of the threaded brace rod so as to directly distinguish each type of threaded brace rod.

6. The manual rivet tool according to claim 1, wherein the quick replacement mechanism comprises a reset spring and a replacement sleeve; the reset spring is sleeved on the bottom end of the pull rod, and the upper end of the reset spring abuts against the bottom end of the ball screw; one end of the replacement sleeve is sleeved on the pull rod and the other end thereof is sleeved and connected to the threaded brace rod; and both the threaded brace rod and the pull rod are provided with connecting ends corresponding to the replacement sleeve.

7. The manual rivet tool according to claim 2, wherein the planetary accelerating rotating mechanism comprises a knob, a knob base, an internal gear, an internal gear base, a planetary gear base and three planetary gears mounted on the planetary gear base, wherein, the internal gear is disposed in the internal gear base, the internal gear base is sleeved on the knob base, and the knob base is fixed to the force amplification pulling mechanism by means of the bolt; the planetary gear base is mounted in the middle of the internal gear base, the three planetary gears mounted on the planetary gear base are simultaneously engaged with the internal gear and the sun gear on the pull rod, and the knob is connected to the planetary gear base.

8. The manual rivet tool according to claim 1, wherein the second handle assembly comprises a second handle bar, a pawl spring, a steel ball and a ratchet pawl; the front end of the second handle bar is provided with an inner hole, the pawl spring is disposed at the innermost side of the inner hole, the steel ball abuts against the ratchet pawl under the elastic force of the pawl spring, and the ratchet pawl clings to the ratchet under the action of the steel ball and catches teeth of the ratchet.

* * * * *